US012673747B2

(12) United States Patent
Xia et al.

(10) Patent No.: US 12,673,747 B2
(45) Date of Patent: Jul. 7, 2026

(54) GAS SUPPLY SYSTEM APPLICABLE TO GAS LAYER DRAG REDUCTION SHIP, AND SHIP

(71) Applicant: CSSC Shanghai Marine Energy Saving Technology Co., Ltd., Shanghai (CN)

(72) Inventors: Haochao Xia, Shanghai (CN); Lijin Gao, Shanghai (CN); Shaofeng Chen, Shanghai (CN); Qiuqin Yun, Shanghai (CN); Zan Wu, Shanghai (CN); Guofu Huang, Shanghai (CN); Shuquan Huang, Shanghai (CN)

(73) Assignee: CSSC Shanghai Marine Energy Saving Technology Co., Ltd., Shanghai (CN)

( * ) Notice: Subject to any disclaimer, the term of this patent is extended or adjusted under 35 U.S.C. 154(b) by 521 days.

(21) Appl. No.: 18/547,004

(22) PCT Filed: Mar. 4, 2021

(86) PCT No.: PCT/CN2021/079052
§ 371 (c)(1),
(2) Date: Feb. 2, 2024

(87) PCT Pub. No.: WO2022/174476
PCT Pub. Date: Aug. 25, 2022

(65) Prior Publication Data

US 2024/0190534 A1 Jun. 13, 2024

(30) Foreign Application Priority Data

Feb. 19, 2021 (CN) ..... 202110195731.6

(51) Int. Cl.
*B63B 1/38* (2006.01)
*B63B 79/10* (2020.01)
(Continued)

(52) U.S. Cl.
CPC ..... *B63B 1/38* (2013.01); *B63B 79/10* (2020.01); *B63J 2/12* (2013.01); *B63B 17/0027* (2013.01)

(58) Field of Classification Search
CPC ..... B63B 1/00; B63B 1/38; B63B 17/0027; B63B 39/00; B63B 39/14; B63B 79/00;
(Continued)

(56) References Cited

U.S. PATENT DOCUMENTS 8,327,784 B2 * 12/2012 Costas ..... B63B 1/38 114/67 A
8,763,547 B2 * 7/2014 Costas ..... B63B 1/38 114/67 A
2008/0083361 A1 4/2008 Iglesias Schoo

FOREIGN PATENT DOCUMENTS

CN 103908791 A 7/2014
CN 204187760 U 3/2015
(Continued)

OTHER PUBLICATIONS

Office Action issued on Jul. 17, 2024 in JP2023-550683.
(Continued)

*Primary Examiner* — Lars A Olson
(74) *Attorney, Agent, or Firm* — Fox Rothschild LLP

(57) ABSTRACT

An air supply system applicable to an air layer drag reduction ship includes an air tank and a cooling assembly. The air tank is provided with an air outlet pipeline and multiple air inlet pipelines. The air outlet pipeline and the air inlet pipelines are each provided with a first monitoring assembly and a first remote control valve. The cooling assembly is disposed inside the air tank and includes a liquid inlet pipe and a liquid outlet pipe, where the liquid outlet pipe is provided with a second monitoring assembly, the liquid inlet pipe is provided with a second remote control valve, and the second monitoring assembly and the first monitoring assem-
(Continued)

bly are communicatively connected to the second remote control valve. The air supply system is capable of supplying stable and low-temperature air.

20 Claims, 7 Drawing Sheets

(51) Int. Cl.
*B63J 2/12* (2006.01)
*B63B 17/00* (2006.01)

(58) Field of Classification Search
CPC .... B63B 79/10; B63J 2/00; B63J 2/12; B63H 21/00; B63H 21/14; B63H 21/21; F02B 37/04; F17C 13/00; F17C 13/02
USPC ..... 114/67 A
See application file for complete search history.

(56) References Cited

FOREIGN PATENT DOCUMENTS

| | | | |
|---|---|---|---|
| CN | 104903185 | A | 9/2015 |
| CN | 106458290 | A | 2/2017 |
| CN | 106660612 | A | 5/2017 |
| CN | 110758634 | A | 2/2020 |
| CN | 110949603 | A | 4/2020 |
| CN | 111795294 | A | 10/2020 |
| CN | 214420652 | U | 10/2021 |
| EP | 3162690 | B1 | 3/2019 |
| JP | S62286886 | A | 12/1987 |
| JP | H0684168 | U | 12/1994 |
| JP | 2014040245 | A | 3/2014 |
| JP | 2020143670 | A | 9/2020 |
| JP | 2020164054 | A | 10/2020 |
| KR | 20160054857 | A | 5/2016 |
| KR | 101690990 | B1 | 12/2016 |
| KR | 20170075378 | A | 7/2017 |
| KR | 20200137956 | A | 12/2020 |
| WO | 2012114840 | A1 | 8/2012 |
| WO | 2013002182 | A1 | 1/2013 |
| WO | 2015198613 | A1 | 12/2015 |
| WO | 2018168585 | A1 | 9/2018 |
| WO | 2018186050 | A1 | 10/2018 |

OTHER PUBLICATIONS

International Search Report issued on Sep. 26, 2021 for International Patent Application No. PCT/CN2021/079052 (2 pages).
European Search Report issued on Feb. 24, 2025 for European Patent Application No. 21926193.0 (5 pages).
First Chinese Search Report issued on Oct. 24, 2024 for Chinese Patent Application No. 2021101957316 (3 pages).

* cited by examiner

GAS SUPPLY SYSTEM APPLICABLE TO GAS LAYER DRAG REDUCTION SHIP, AND SHIP

CROSS-REFERENCE TO RELATED APPLICATIONS

This is a U.S. national stage application under 37 U.S.C. 371 based on International Patent Application No. PCT/CN2021/079052, filed on Mar. 4, 2021, which claims priority to Chinese Patent Application No. 202110195731.6 filed with the China National Intellectual Property Administration (CNIPA) on Feb. 19, 2021, the disclosures of which are incorporated herein by reference in their entirety.

TECHNICAL FIELD

The present application relates to the technical field of air layer drag reduction ships, for example, an air supply system applicable to an air layer drag reduction ship and a ship.

BACKGROUND

An air layer drag reduction system of a ship includes subsystems, such as air supply, pressure stabilization, air injection, control. An air supply system uses multiple air compressors for air supply. When the number of air compressors is relatively large, the multiple air compressors interfere with each other, complex pipeline structures affect each other, and a pipeline connection has a relatively great loss, resulting in the unstable output of the air supply system and an unstable gas in a pipeline. Meanwhile, a conventional low-pressure air compressor, such as an oil-free screw air compressor, discharges a gas with a relatively high temperature which can reach more than 100° C. or even 200° C. When a high-temperature gas runs in the pipeline, damage or danger is caused.

SUMMARY

The present application provides an air supply system applicable to an air layer drag reduction ship and a ship to connect air compressors, stabilize output air, and reduce the temperature of the output air, thereby improving the applicability and stability of the air supply system.

An air supply system applicable to an air layer drag reduction ship is provided. The air supply system includes an air tank and a cooling assembly.

The air tank is provided with an air outlet pipeline and multiple air inlet pipelines, where the air outlet pipeline and the multiple air inlet pipelines are each provided with a first monitoring assembly and a first remote control valve, the first monitoring assembly is configured to monitor a temperature, pressure, and a flow of air in the air outlet pipeline or one of the multiple air inlet pipelines corresponding to the first monitoring assembly, and the first remote control valve is configured to control an air flow through the air outlet pipeline or one of the multiple air inlet pipelines corresponding to the first remote control valve.

The cooling assembly is disposed inside the air tank and configured to reduce a temperature of air in the air tank; where the cooling assembly includes a liquid inlet pipe and a liquid outlet pipe, the liquid outlet pipe is provided with a second monitoring assembly, the second monitoring assembly is configured to monitor a temperature and a flow of a fluid in the liquid outlet pipe, the liquid inlet pipe is provided with a second remote control valve, the second monitoring assembly and the first monitoring assembly are communicatively connected to the second remote control valve, and the second remote control valve is configured to control a liquid flow through the liquid inlet pipe according to monitoring results of the second monitoring assembly and the first monitoring assembly.

A ship including the preceding air supply system is further provided.

REFERENCE LIST

Figure 1:
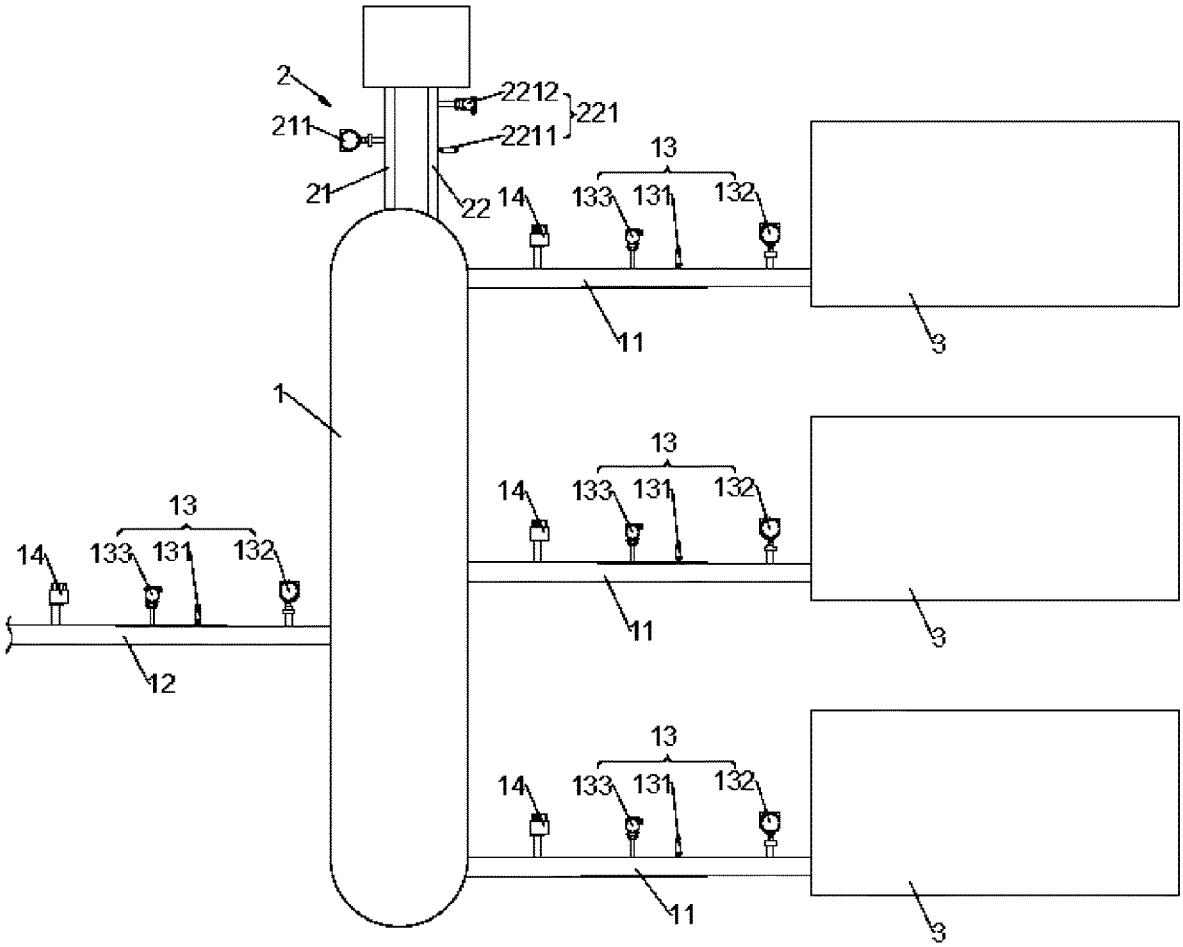
FIG. 1 is a structural diagram of an air supply system according to an embodiment of the present application.

1 air tank
11 air inlet pipeline
12 air outlet pipeline
13 first monitoring assembly
131 first temperature sensor
132 first pressure sensor
133 first flow sensor
14 first remote control valve
15 baffle plate
16 inner wall
17 outer wall
18 third cooling coil
19 heat sink fin
2 cooling assembly
21 liquid inlet pipe
211 second remote control valve
22 liquid outlet pipe
221 second monitoring assembly
2211 second temperature sensor
2212 second flow sensor
23 first cooling coil
24 second cooling coil
3 air compressor

DETAILED DESCRIPTION

Hereinafter technical solutions in embodiments of the present application are described in conjunction with the drawings in the embodiments of the present application. Generally, components of embodiments of the present application described and illustrated in the drawings may be arranged and designed through various configurations.

Similar reference numerals and letters indicate similar items in the drawings. Therefore, once an item is defined in one drawing, the item no longer needs to be defined and explained in subsequent drawings.

In the description of the present application, orientations or position relations indicated by terms such as "upper", "lower", "left", "right", "vertical", "horizontal", "in", and "out" are based on the drawings or those of the product of the present application usually placed during use. These orientations or position relations are intended only to facilitate and simplify the description of the present application and not to indicate or imply that a device or element referred to must have such particular orientations or must be configured or operated in such particular orientations. Thus, these orientations or position relations are not to be construed as limiting the present application. Moreover, terms such as "first", "second", and "third" are used only for distinguishing description and are not to be construed as indicating or implying relative importance. In the description of the present application, unless otherwise noted, the term "a plurality of" or "multiple" means two or more.

In the description of the present application, terms "disposed" and "connected" are to be understood in a broad sense unless otherwise specified and limited. For example, the term "connected" may refer to "securely connected", "detachably connected", or "integrally connected" or may refer to "mechanically connected" or "electrically connected". Meanings of the preceding terms in the present application may be understood based on specific situations.

In the present application, unless otherwise specified and limited, when a first feature is described as "on" or "under" a second feature, the first feature and the second feature may be in direct contact or be in contact via another feature between the two features instead of being in direct contact. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below, or underneath the second feature, the first feature is obliquely under, below, or underneath the second feature, or the first feature is simply at a lower level than the second feature.

The embodiments of the present application are described below. Examples of the embodiments are shown in the drawings, where the same or similar reference numerals indicate the same or similar elements or elements having the same or similar functions.

As shown in FIG. 1, this embodiment provides an air supply system applicable to an air layer drag reduction ship, and the air supply system includes an air tank 1 and a cooling assembly 2. The air tank 1 is provided with an air outlet pipeline 12 and multiple air inlet pipelines 11, the air outlet pipeline 12 and each air inlet pipeline 11 are provided with a first monitoring assembly 13 and a first remote control valve 14, multiple first monitoring assemblies 13 can monitor the temperature, pressure, and flow of air in the corresponding air outlet pipeline 12 and air inlet pipelines 11, and multiple first remote control valves 14 can control air flows through the air outlet pipeline 12 and the air inlet pipelines 11, respectively; the cooling assembly 2 is disposed inside the air tank 1 and can reduce the temperature of air in the air tank 1; and the cooling assembly 2 includes a liquid inlet pipe 21 and a liquid outlet pipe 22, the liquid outlet pipe 22 is provided with a second monitoring assembly 221, the second monitoring assembly 221 can monitor the temperature and the flow of a fluid in the liquid outlet pipe 22, the liquid inlet pipe 21 is provided with a second remote control valve 211, the second monitoring assembly 221 and each first monitoring assembly 13 are communicatively connected to the second remote control valve 211, and the second remote control valve 211 can control a liquid flow through the liquid inlet pipe 21 according to monitoring results of the second monitoring assembly 221 and each first monitoring assembly 13.

Figure 2:
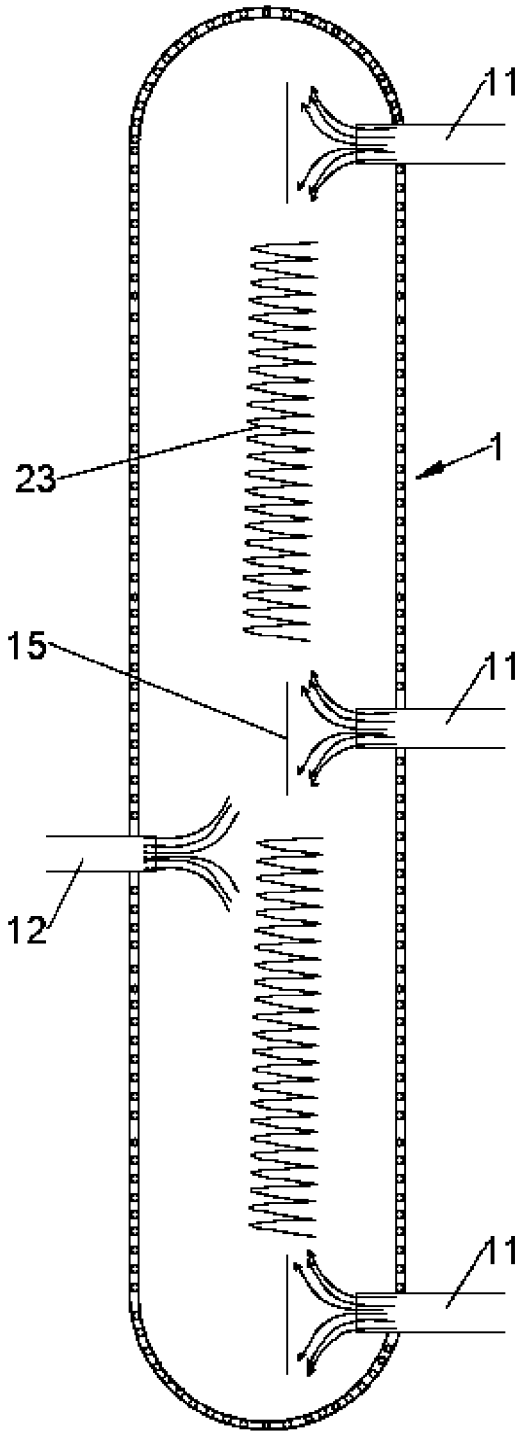
FIG. 2 is a sectional view of an air tank according to an embodiment of the present application.
Figure 3:
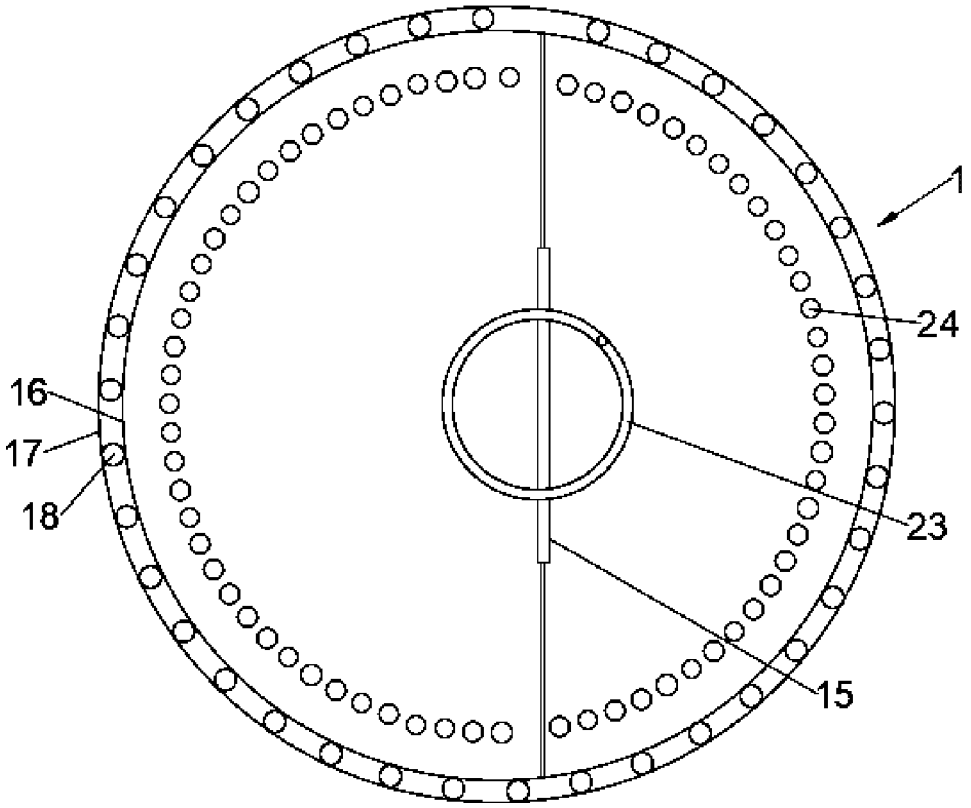
FIG. 3 is a cross-sectional view of an air tank according to an embodiment of the present application.

As shown in FIGS. 2 and 3, in this embodiment, liquid cooling is used for lowering the temperature, and a cooling liquid is, but not limited to, any one of fresh water, seawater, or oil. A tank wall of the air tank 1 includes an inner wall 16 and an outer wall 17, a third cooling coil 18 is disposed between the inner wall 16 and the outer wall 17, and the third cooling coil 18 includes an end communicating with the liquid inlet pipe 21 and the other end communicating with the liquid outlet pipe 22. The air tank 1 is an elongated cylindrical tank body, and the volume of the air tank 1 is determined according to requirements on an air flow required for operation of the air supply system configured for a ship and the temperature of output air.

In an embodiment, multiple air outlet pipelines 12 may be provided.

The air supply system may also include multiple air compressors 3 corresponding to the multiple air inlet pipelines 11 one to one, where an end of the air inlet pipeline 11 is connected to the corresponding air compressor 3.

In this embodiment, the designed air tank 1 and connection form are used, as a buffer module between the air compressors 3 and an air transportation pipeline, to connect the air compressors 3, stabilize the output air, adjust an air supply form, and reduce the temperature of the output air, thereby improving the applicability and stability of the air supply system. The liquid outlet pipe 22 and the air outlet pipeline 12 are monitored in real time so that whether to add the cooling liquid from the outside and a flow rate at which the cooling liquid is added are carefully adjusted, so as to provide air with a suitable temperature and save energy.

In this embodiment, three air inlet pipelines 11 are provided. Each air inlet pipeline 11 includes an end connected to one air compressor 3 and the other end communicating with the inside of the air tank 1. The air tank 1 is used as a buffer module between the air compressors 3 and the air outlet pipeline 12 to connect the air compressors 3, stabilize the output air, and reduce the temperature of the output air, thereby improving the applicability and stability of the air supply system. The air inlet pipelines 11 and the air outlet pipeline 12 are disposed on two sides of the air tank 1 respectively so that the air enters the air tank 1 through the air inlet pipelines 11, fully exchanges heat with the cooling assembly 2, and then is discharged out of the air tank 1 through the air outlet pipeline 12.

The cooling assembly 2 may include multiple first cooling coils 23, the first cooling coil 23 is disposed between every two adjacent air inlet pipelines 11, each first cooling coil 23 extends along a length direction of the air tank 1, and the first cooling coil 23 has an end communicating with the liquid inlet pipe 21 and the other end communicating with the liquid outlet pipe 22. The first cooling coil 23 is disposed at the center of the air tank 1, is in the shape of a helix, and extends along the length direction of the air tank 1.

The cooling assembly 2 may also include a second cooling coil 24 disposed along the inner wall 16 of the air tank 1. The second cooling coil 24 includes an end communicating with the liquid inlet pipe 21 and the other end communicating with the liquid outlet pipe 22. The second cooling coil 24 is wound along the inner wall 16 of the air tank 1 to surround the air in the air tank 1 and provides a better cooling effect in conjunction with the first cooling coils 23 at the center of the air tank 1.

The air supply system also includes a cooling liquid circulation device. The cooling liquid enters the first cooling coil 23, the second cooling coil 24, and the third cooling coil 18 through the liquid inlet pipe 21, is circulated, and returns to the cooling liquid circulation device through the liquid outlet pipe 22 for reuse.

The first monitoring assembly 13 includes a first temperature sensor 131, a first pressure sensor 132, and a first flow sensor 133 for monitoring the temperature, the pressure, and the flow of the air in the corresponding air outlet pipeline 12 or air inlet pipeline 11, respectively.

The second monitoring assembly 221 includes a second temperature sensor 2211 and a second flow sensor 2212 for monitoring the temperature and the flow of the fluid in the liquid outlet pipe 22, respectively.

Figure 4:
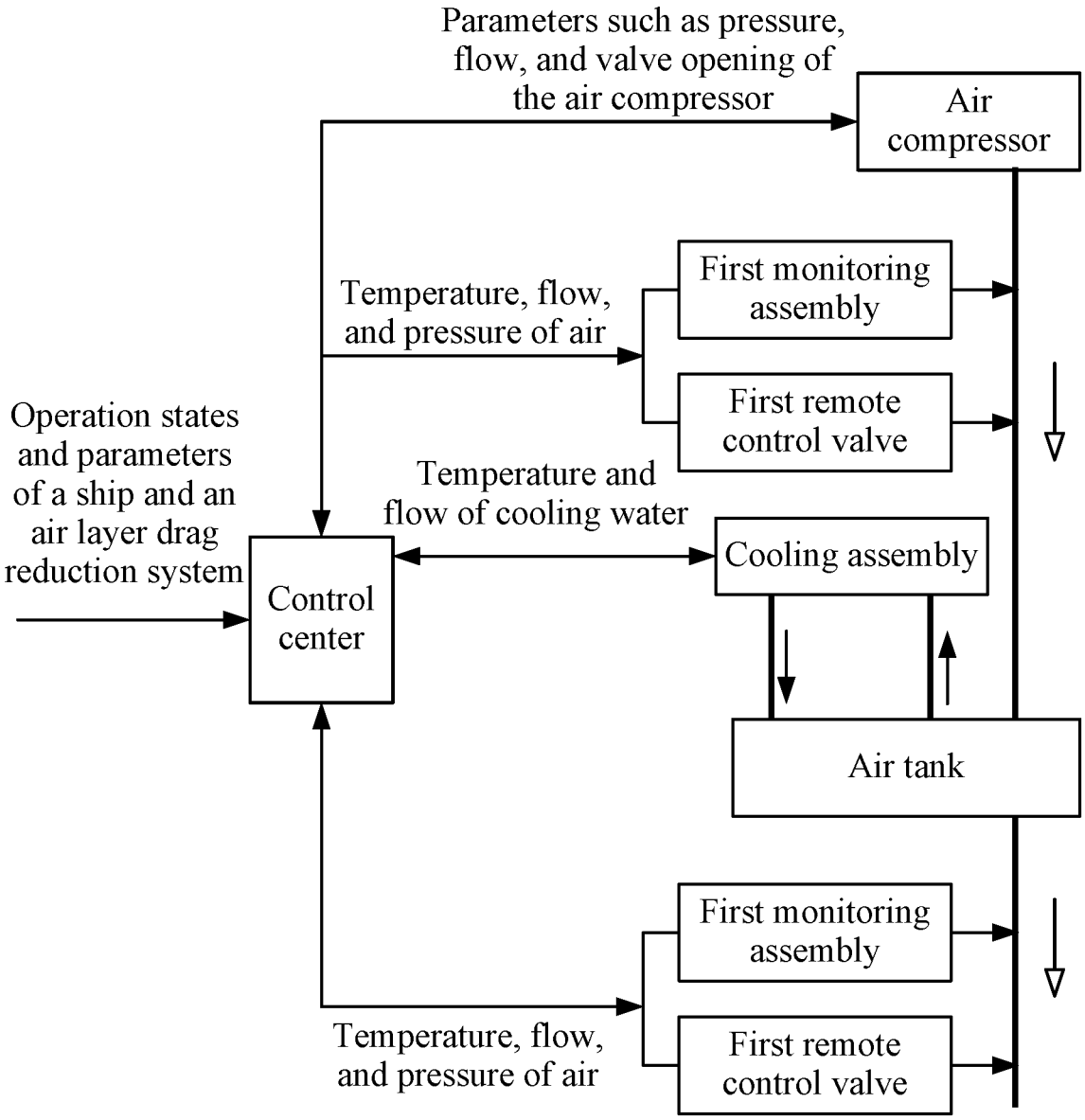
FIG. 4 is a diagram of control principles of an air supply system according to an embodiment of the present application.

As shown in FIG. 4, a thin solid line represents a signal transmission route, a thick solid line represents a pipeline, an open-headed arrow represents a flow direction of air, and a solid arrow represents a flow direction of the cooling liquid. The air supply system also includes a control center, where the air compressor 3, the first remote control valve 14, the second remote control valve 211, the first temperature sensor 131, the first pressure sensor 132, the first flow sensor 133, the second temperature sensor 2211, and the second flow sensor 2212 are all communicatively connected to the control center. The control center can control each first remote control valve 14 to turn on or off and control an opening of the first remote control valve 14 to control the air flow through the corresponding air outlet pipeline 12 or air inlet pipeline 11. The control center can control the second remote control valve 211 to turn on or off according to the monitoring results of the second monitoring assembly 221 and each first monitoring assembly 13, and can control an opening of the second remote control valve 211 to control the liquid flow through the liquid inlet pipe 21.

When the ship is fully loaded, the control center controls all three air compressors 3 to turn on and controls rotational speeds of the air compressors 3. The air compressors 3 discharge air with certain pressure and a certain flow. The control center detects the flow and the temperature of air discharged from the air compressor 3 through the first monitoring assembly 13 on each of the three air inlet pipelines 11, calculates the flow and temperature of intake air, and controls an amount and a flow rate of the cooling liquid through the second remote control valve 211. When the ship is in ballast, the control center turns only one air compressor 3 on to reduce the flow and then controls the second remote control valve 211 to reduce the opening of the second remote control valve 211 so that the amount and the flow rate of the cooling liquid can be reduced. After an air layer drag reduction system of the ship operates for a long term, the required flow decreases, one or two air compressors 3 may be turned off to reduce the air flow, and then the second remote control valve 211 is controlled to reduce the opening of the second remote control valve 211 so that the amount and the flow rate of the cooling liquid are reduced, thereby reducing an energy loss. When the air compressor 3 is turned off, the first remote control valve 14 on the corresponding air inlet pipeline 11 is also turned off, so as to prevent the backflow of air.

The control center monitors the temperature, flow, and pressure of air in the air outlet pipeline 12 through the first monitoring assembly 13 on the air outlet pipeline 12, monitors the temperature and the flow of the returning cooling waste liquid through the second monitoring assembly 221 on the liquid outlet pipe 22, and controls, according to monitoring results, the second remote control valve 211 to turn on or off or increase or decrease the opening, so as to adjust the flow rate at which the cooling liquid enters and adjust a cooling capability. When it is monitored that the temperature of the air in the air outlet pipeline 12 is relatively high, the opening of the second remote control valve 211 is increased, so as to increase the amount and the flow rate of the cooling liquid, improve the cooling capability of the cooling assembly 2, and rapidly cool the air in the air tank 1. When it is monitored that the temperature of the air in the air outlet pipeline 12 is relatively low, the opening of the second remote control valve 211 is decreased, so as to reduce the amount and the flow rate of the cooling liquid and reduce the energy loss.

Figure 5:
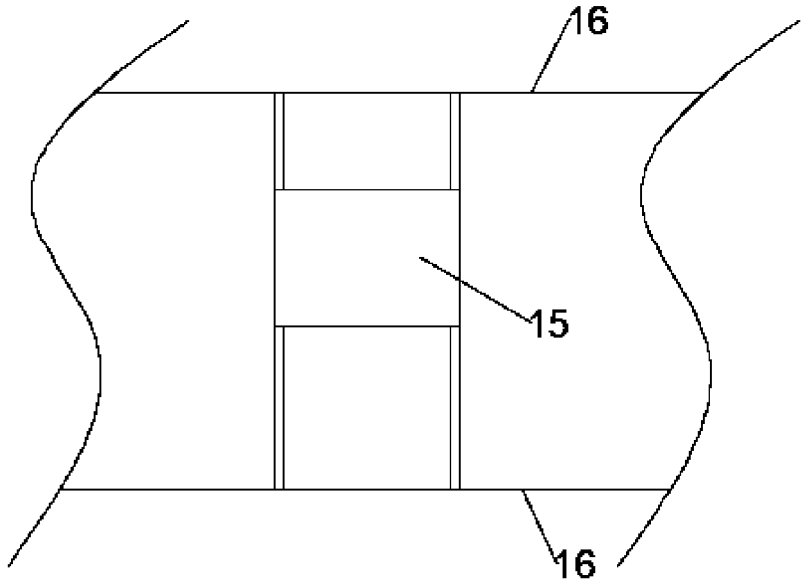
FIG. 5 is a schematic diagram of a mounting manner of a baffle plate according to an embodiment of the present application.

As shown in FIG. 5, multiple baffle plates 15 are provided inside the air tank 1, the multiple baffle plates 15 correspond to the multiple air inlet pipelines 11 one to one, and the baffle plate 15 is disposed directly in front of an air outlet end of the air inlet pipeline 11. The baffle plate 15 is disposed opposite the air outlet end of the air inlet pipeline 11 and is a rectangular or square plate. The baffle plate 15 is connected to the inner wall 16 of the air tank 1 through a reinforcing support structure to ensure structural strength and safety of the baffle plate 15. A certain gap exists between the baffle plate 15 and the air outlet end of the air inlet pipeline 11 so that air collides with the baffle plate 15, so as to buffer the air and stabilize the pressure of the air. Meanwhile, the air is dispersed so that the air is uniformly in contact with the first cooling coil 23 and the second cooling coil 24 for heat exchange.

Figure 6:
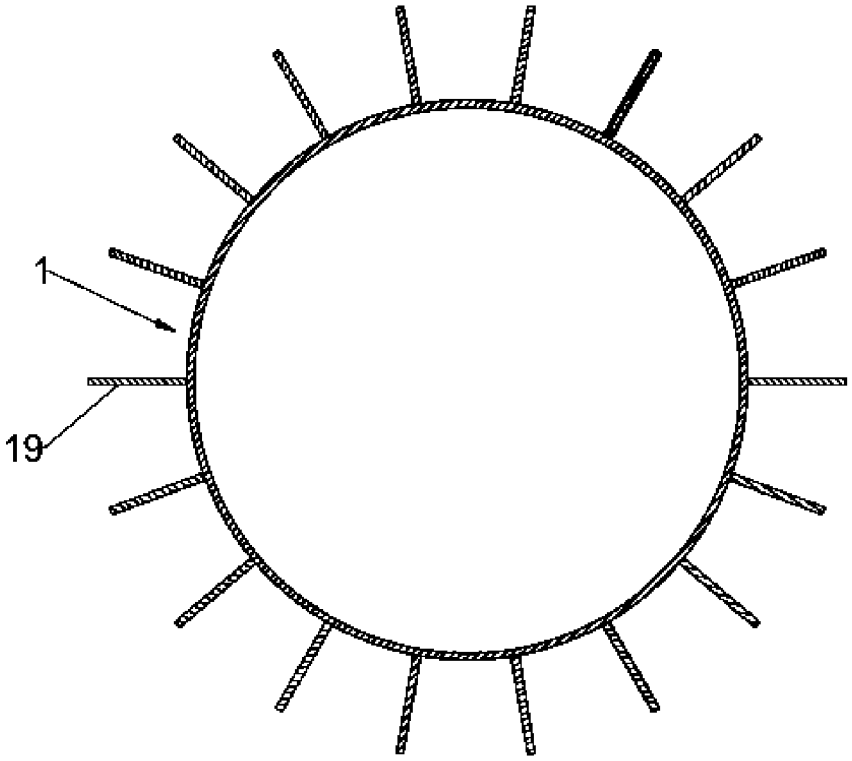
FIG. 6 is a structural diagram of a tank body of an air tank according to an embodiment of the present application.

As shown in FIG. 6, in other embodiments, air cooling is used, and multiple heat sink fins 19 are provided on an outer side of the tank wall of the air tank 1. The heat sink fins 19 are each in the shape of an elongated strip and extend along the length direction of the air tank 1. The multiple heat sink fins 19 are uniformly arranged along a circumferential direction of the air tank 1, thereby ensuring that the air in the air tank 1 is uniformly cooled.

This embodiment further provides a ship including the preceding air supply system. The preceding air supply system is used to avoid mutual interference between multiple air compressors, stabilize air in a pipeline, prolong the service life of the pipeline, and ensure the normal operation of the ship.

Figure 7:
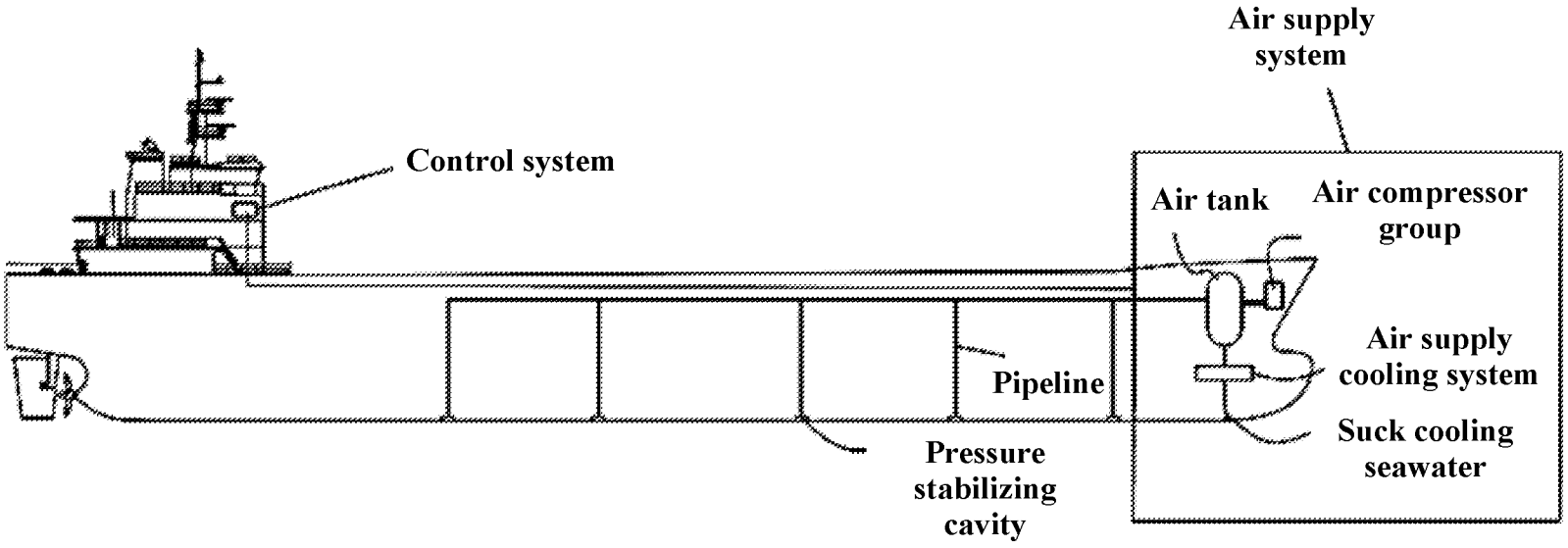
FIG. 7 is a structural diagram of a ship according to an embodiment of the present application.
Figure 8:
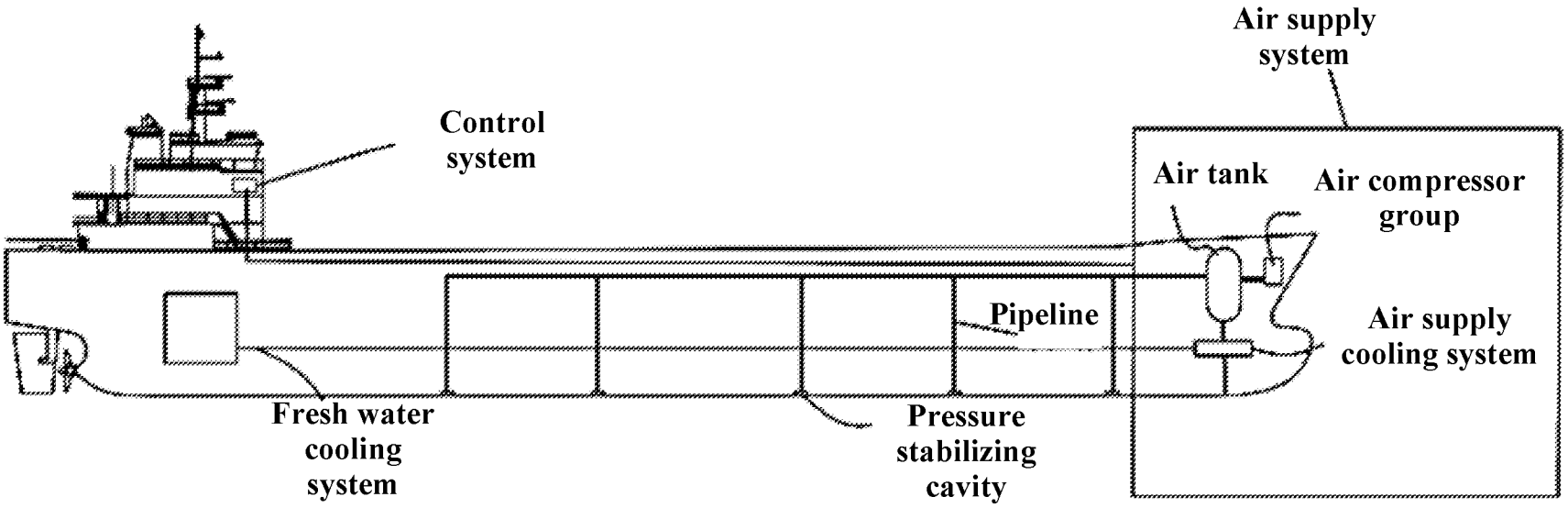
FIG. 8 is a structural diagram of another ship according to an embodiment of the present application.

FIG. 7 is a structural diagram of a ship according to an embodiment of the present application. FIG. 7 shows a position of the air supply system in air layer drag reduction of the whole ship, and a cooling system can perform cooling directly by sucking seawater. FIG. 8 is a structural diagram of another ship according to an embodiment of the present application. FIG. 8 shows the position of the air supply system in the air layer drag reduction of the whole ship, and the cooling system can perform cooling by using fresh water stored in the ship.

What is claimed is:

1. An air supply system, applicable to an air layer drag reduction ship, comprising:

an air tank provided with an air outlet pipeline and a plurality of air inlet pipelines, wherein the air outlet pipeline and the plurality of air inlet pipelines are each provided with a first monitoring assembly and a first remote control valve, the first monitoring assembly is configured to monitor a temperature, pressure, and a flow of air in the air outlet pipeline or one of the plurality of air inlet pipelines corresponding to the first monitoring assembly, and the first remote control valve is configured to control an air flow through the air outlet pipeline or one of the plurality of air inlet pipelines corresponding to the first remote control valve; and a cooling assembly disposed inside the air tank and configured to reduce a temperature of air in the air tank; wherein the cooling assembly comprises a liquid inlet pipe and a liquid outlet pipe, the liquid outlet pipe is provided with a second monitoring assembly, the second monitoring assembly is configured to monitor a temperature and a flow of a fluid in the liquid outlet pipe, the liquid inlet pipe is provided with a second remote control valve, the second monitoring assembly and the first monitoring assembly are communicatively connected to the second remote control valve, and the second remote control valve is configured to control a liquid flow through the liquid inlet pipe according to monitoring results of the second monitoring assembly and the first monitoring assembly.

2. The air supply system according to claim 1, wherein a plurality of baffle plates are provided inside the air tank, the plurality of baffle plates correspond to the plurality of air inlet pipelines one to one, and each baffle plate of the plurality of baffle plates is disposed directly in front of an air outlet end of a corresponding one of the plurality of air inlet pipelines.

3. The air supply system according to claim 1, wherein the cooling assembly further comprises a plurality of first cooling coils, one of the plurality of first cooling coils is disposed between every two adjacent air inlet pipelines, each of the plurality of first cooling coils extends along a length direction of the air tank, and each of the plurality of first cooling coils has an end communicating with the liquid inlet pipe and another end communicating with the liquid outlet pipe.

4. The air supply system according to claim 1, wherein the cooling assembly further comprises a second cooling coil disposed along an inner wall of the air tank, wherein the second cooling coil comprises an end communicating with the liquid inlet pipe and another end communicating with the liquid outlet pipe.

5. The air supply system according to claim 1, further comprising a plurality of air compressors corresponding to the plurality of air inlet pipelines one to one, wherein an end of each air inlet pipeline of the plurality of air inlet pipelines is connected to a corresponding one of the plurality of air compressors.

6. The air supply system according to claim 1, wherein the first monitoring assembly comprises a first temperature sensor, a first pressure sensor, and a first flow sensor configured to monitor the temperature, the pressure, and the flow of the air in the air outlet pipeline or one of the plurality of air inlet pipelines corresponding to the first monitoring assembly, respectively.

7. The air supply system according to claim 1, wherein the second monitoring assembly comprises a second temperature sensor and a second flow sensor configured to monitor the temperature and the flow of the fluid in the liquid outlet pipe.

8. The air supply system according to claim 1, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

9. The air supply system according to claim 1, wherein a plurality of heat sink fins are provided on an outer side of a tank wall of the air tank.

10. A ship, comprising a pressure stabilizing cavity, and the air supply system according to claim 1.

11. The air supply system according to claim 2, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

12. The air supply system according to claim 3, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

13. The air supply system according to claim 4, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

14. The air supply system according to claim 5, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

15. The air supply system according to claim 6, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

16. The air supply system according to claim 7, wherein a tank wall of the air tank comprises an inner wall and an outer wall, a third cooling coil is disposed between the inner wall and the outer wall, and the third cooling coil comprises an end communicating with the liquid inlet pipe and another end communicating with the liquid outlet pipe.

17. The air supply system according to claim 2, wherein a plurality of heat sink fins are provided on an outer side of a tank wall of the air tank.

18. The air supply system according to claim 3, wherein a plurality of heat sink fins are provided on an outer side of a tank wall of the air tank.

19. The air supply system according to claim 4, wherein a plurality of heat sink fins are provided on an outer side of a tank wall of the air tank.

20. The air supply system according to claim 5, wherein a plurality of heat sink fins are provided on an outer side of a tank wall of the air tank.

* * * * *